United States Patent [19]

Meyer

[11] 4,086,793

[45] May 2, 1978

[54] DEVICE FOR MOISTENING AND CONDITIONING LEATHER AND THE LIKE

[75] Inventor: Gerd Meyer, Mulheim, Rhur, Germany

[73] Assignee: USM Corporation, Farmington, Conn.

[21] Appl. No.: 783,205

[22] Filed: Mar. 31, 1977

[30] Foreign Application Priority Data

Apr. 7, 1976 Germany ..... 2615131

[51] Int. Cl.[2] ..... C14B 1/00

[52] U.S. Cl. ..... 69/32; 69/47; 69/48

[58] Field of Search ..... 69/32, 47, 48, 29, 28; 100/93 PP, 93 P

[56] References Cited

U.S. PATENT DOCUMENTS

| | | | |
|---|---|---|---|
| 3,727,437 | 4/1973 | Dokoupil | 69/48 |
| 3,872,695 | 3/1975 | Busek | 69/47 |
| 3,938,356 | 2/1976 | Arendt | 69/32 |

FOREIGN PATENT DOCUMENTS

| | | | |
|---|---|---|---|
| 2,351,307 | 4/1975 | Germany | 69/48 |
| 986,006 | 3/1965 | United Kingdom | 69/48 |

*Primary Examiner*—Alfred R. Guest

*Attorney, Agent, or Firm*—Donald N. Halgren; Richard B. Megley; Vincent A. White

[57] ABSTRACT

This invention relates to apparatus for moistening and conditioning sheet materials for example leathers and similar materials. The apparatus comprises two endless moisture-absorbent conveyor belts which come together, in the operation of the apparatus, between a pair of opposed flat presser surfaces. The apparatus comprises means for moistening the conveyor belts and for heating at least one of the flat surfaces. The apparatus also comprises means for moving the flat surfaces apart to permit introduction of material carried between the conveyor belts into the region between the flat surfaces and together to press the material on the belt. By reason of this pressure an intensive heat transfer occurs from the flat surfaces to the conveyor belt whereby the water in the conveyor belt is evaporated and transferred into the leather. The apparatus further comprises drive means whereby the belts are moved to transport the leather or other sheet material only while the flat surfaces are spaced apart.

8 Claims, 2 Drawing Figures

DEVICE FOR MOISTENING AND CONDITIONING LEATHER AND THE LIKE

BACKGROUND OF THE INVENTION

In processing leather it is necessary to ensure, before carrying out certain operations, that the moisture content of the leather is within the preferred range. Accordingly it has previously been proposed to introduce moisture into leather using a suitable apparatus. One known apparatus for moistening and conditioning leather is described in U.K. patent specification No. 1,288,735 (Statni Vyzkumny Ustav Kozedelny). The apparatus described in this British patent specification comprises heater rolls of relatively large diameter and two conveyor belts between which the leather is transported, the belts being guided on an S-shape path round the heater rolls. This known apparatus further comprises guiding rollers disposed before and after the heater rolls, which ensure that the conveyor belts are brought together prior to reaching the heater rolls and are separated again after they have passed the heater rolls. At the input side of the conveyor belts (that is before the belts reach the heater rolls as they travel along), the conveyor belts are moistened. By reason of the S-shaped course of the conveyor belts round the heater rolls a number of guiding rollers are necessary, thus incurring considerable expense. Furthermore alignment of the conveyor belt is difficult in the event that it is necessary to replace one or both of the belts. In addition it is impossible to use endless belts when replacing the belts: after the belts have been aligned in the apparatus, they must be connected, and this gives rise to a region at the connecting point where the capacity of the belt to take up water is different from that of the remainder of the belt. This causes a corresponding change in the degree of moistening of the leather at the region where the leather is transported in contact with the connecting region of the conveyor belt. In this known apparatus the duration of moistening depends upon the speed of the conveyor belt and thus the throughput of the apparatus is dependent upon the duration of moistening required. The duration of moistening should be adjusted in accordance with the type of leather to be operated upon, so that when a change occurs in the type of leather to be operated upon the known apparatus must operate at a different throughput speed.

SUMMARY OF THE INVENTION

The invention provides apparatus for moistening and conditioning sheet material, for example leather, comprising two presser members having flat, or substantially flat, presser surfaces situated opposite each other, power means connecting the presser members and by which the presser members may be moved relatively towards each other to exert pressure on sheet material disposed therebetween and apart to relieve the pressure, heating means for heating at least one of the flat surfaces, at least one conveyor belt passing between the surfaces, drive means by which the belt can be moved while the surfaces are spaced apart by the power means to transport sheet material on the belt to the region between the flat surfaces for pressing by the flat surfaces and for carrying the sheet material out of the region after it has been pressed, and means for moistening the belt before it enters the region between the flat surfaces.

By reason of the use of the two flat surfaces, the conveyor belt travels, for the most part, in a straight line and only needs its direction of travel reversing twice, once at each end of the apparatus. This facilitates the lining-up of the conveyor belt as it can be introduced into the apparatus from the side thus making possible the use of an endless conveyor belt. By reason of the straight line transport of the leather from the input to the output side of the apparatus, the danger of creasing of the leather is avoided as it is not subjected to any bending while being conveyed. In contrast, the travel of the belts of the known apparatus hereinbefore referred to, along an S-shaped path leads inevitably to a displacement of the belts relative to one another as they pass round the heated rollers due to the differences in radii of curvature of the belts which arise as the belts pass round the heated rollers with first one of the belts and then the other of the belts in contact with successive rollers. In a preferred embodiment the apparatus comprises two conveyor belts and the flat surfaces of both of the presser members are heated. However where only one conveyor belt is used the flat surface contiguous with the belt is preferably heated.

In a preferred embodiment of the apparatus the two presser members are provided by two metal tanks disposed one above the other; these form structural elements of simple design which are simple to heat from inside.

In a preferred embodiment of the apparatus means is provided for adjusting the moisture content of the conveyor belt.

BRIEF DESCRIPTION OF THE DRAWINGS

The above and other features of the invention will become more clear from the following description, to be read with reference to the accompanying drawings, of apparatus for moistening and conditioning leather and similar materials. It will be realised that this apparatus has been selected for description to illustrate the invention by way of example and not of limitation of the invention.

In the accompanying drawings.

DESCRIPTION OF THE ILLUSTRATIVE APPARATUS

Figure 1:
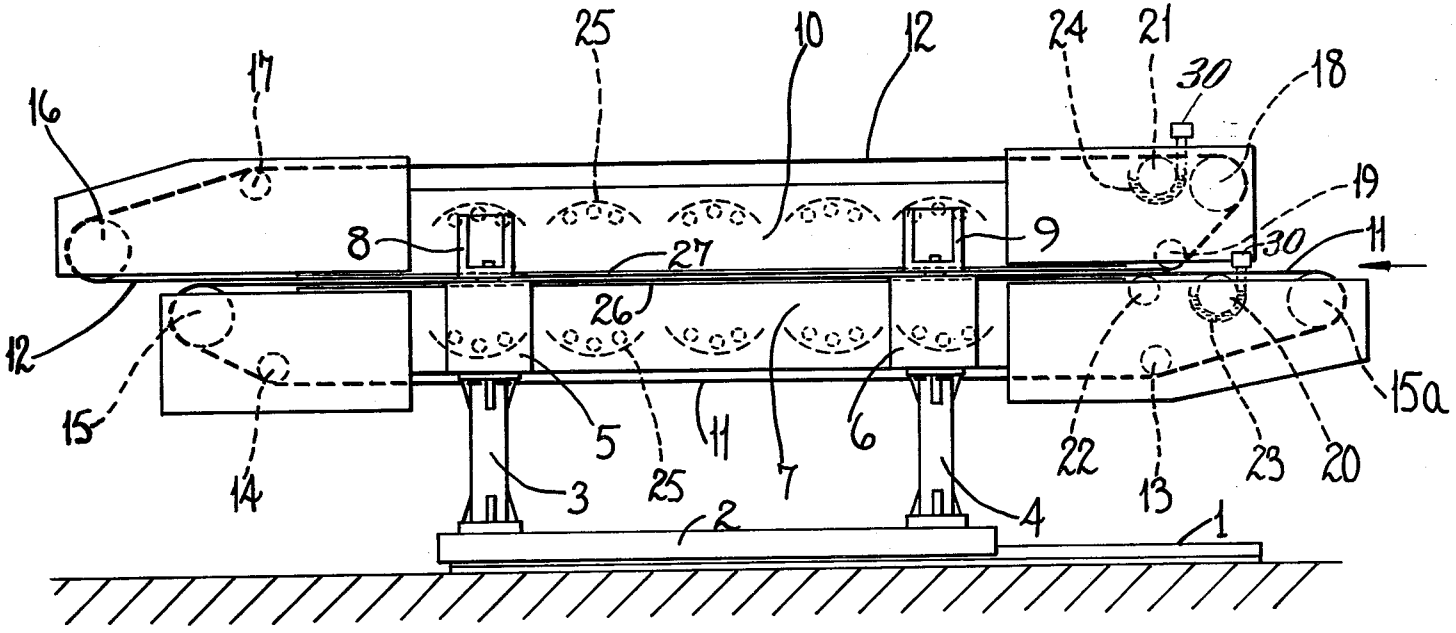
FIG. 1 is a diagrammatic side view of the illustrative apparatus in which metal tanks of the apparatus are shown with flat surfaces thereof pressed together thus to press leather therebetween.

The illustrative apparatus for moistening and conditioning sheet materials such as leather and similar materials is supported on rails 1, over which guides 2 of the apparatus can slide so that the apparatus can be moved to and fro, longitudinally, in order to bring it to a suitable position relative to devices for delivering leather to the illustrative apparatus and for removing leather from the illustrative apparatus. On the guides 2 are mounted four supports 3,3*a*,4,4*a*, which carry at their upper ends power means namely fluid pressure (e.g. hydraulic or pneumatic) operated means viz. piston-cylinder units 5,6 (corresponding piston-cylinder units at the rear of the illustrative apparatus viewing the drawings are not shown). A lower metal tank 7 is secured to the cylinder portion of the piston-cylinder units 5,6. The height of the lower metal tank 7 above the rails 1 is hence determined by the supports 3,3*a*,4,4*a*, and the piston-cylinder units 5,6. The piston rods of the piston-cylinder units 5,6 each carry a bracket 8,9 (only those at the front of the illustrative apparatus viewing the drawings are visible); the brackets are secured to an upper metal tank 10. The metal tanks 7,10 provide presser members of the illustrative apparatus and the power means, namely the piston-cylinder units 5,6 connect the metal tanks 7,10. By operation of the piston-cylinder units 5,6 the metal tanks 7,10 may be moved relatively towards each other to exert pressure on sheet material disposed therebetween and apart to relieve the pressure. By operation of the piston-cylinder units 5,6 the upper metal tank 10 is moved to the desired height position. The metal tank 7 has a flat or substantially flat presser surface 26 and the metal tank 10 has a flat or substantially flat presser surface 27 situated opposite the surface 26.

Whereas in apparatus in accordance with the invention only one of the metal tanks 7,10 may be heated, in the illustrative apparatus described herein both of the tanks 7,10 are heated. The heating of the tanks 7,10 is effected by heating means namely a plurality of electrical radiators 25 which are fitted within each of the tanks 7,10. The radiators 25 radiate heat towards metal plates of the tanks 7,10 which provide the flat presser surfaces 26,27, thus heating the surfaces 26,27 in the operation of the illustrative apparatus.

The illustrative apparatus further comprises two conveyor belts each having a straight run which passes between the flat presser surfaces 26,27. The conveyor belt 11 passes round the lower metal tank 7 and is supported and guided by rollers 13,14,15 and 15*a*. The conveyor belt 12 passes round the upper metal tank 10 and is supported and guided by rollers 16,17,18 and 19. The illustrative apparatus further comprises an additional support roller 22 for the conveyor belt 11. The run of the conveyor belt 11 passing between the tanks 7,10 is guided by the rollers 15,15*a*,22 and the run of the conveyor belt 12 passing between the tanks 7,10 is guided by the rollers 16,19.

The illustrative apparatus also comprises drive means including drive motors (not shown) by which the conveyor belts 11,12 can be moved in the operation of the illustrative apparatus while the metal tanks 7,10 are spaced apart by the piston-cylinder units 5,6. In this way leather supported on the upper run of the conveyor belt 11 may be transported in the direction of the arrow on FIG. 1 into a region between the flat presser surfaces 26,27 for pressing by the presser surfaces 26,27 and may be carried out of the region after it has been pressed. The leather to be processed is in fact carried into the region between the two conveyor belts 11,12 in the operation of the illustrative apparatus.

The conveyor belts 11,12 each comprise a water absorbent material, for example a woven synthetic fabric. The illustrative apparatus comprises means for moistening the conveyor belts before they enter the region between the flat surfaces, comprising rollers 20,21 mounted for rotation in the apparatus with a surface of the roller 20 in contact with the upper run of the conveyor belt 11 and with a surface of the roller 21 in contact with the conveyor belt 12. The means for moistening the conveyor belts 11,12 of the illustrative apparatus further comprises water containers 23,24 (one associated with each of the rollers 20,21). Means of the illustrative apparatus is provided for adjusting the moisture content of the belts 11,12 this means comprising means for adjusting the depth to which the rollers 20,21 dip into water in the containers 23,24. The means for adjusting the depth comprising a known device, such as an adjustable float with a fill and drain valve arrangement 30, or the like. by which the height of the water containers 23,24 may be adjusted (relative to the rollers) thereby to adjust the depth to which the rollers 20,21 dip into water contained in the associated one of the containers 23,24; the absorption of water by the rollers is thus adjusted. The rollers 20,21 comprise a sponge-like material so that they are capable of taking up water out of the containers 23,24 and of transferring it to the conveyor belts 11,12 by reason of the contact between the belts 11,12 and rollers 20,21. The rollers 20,21 are rotated by the conveyor belts 11,12 by friction. In this way it is ensured that the conveyor belts 11,12 receive sufficient moistening before their entry between the metal tanks 7,10.

Figure 2:
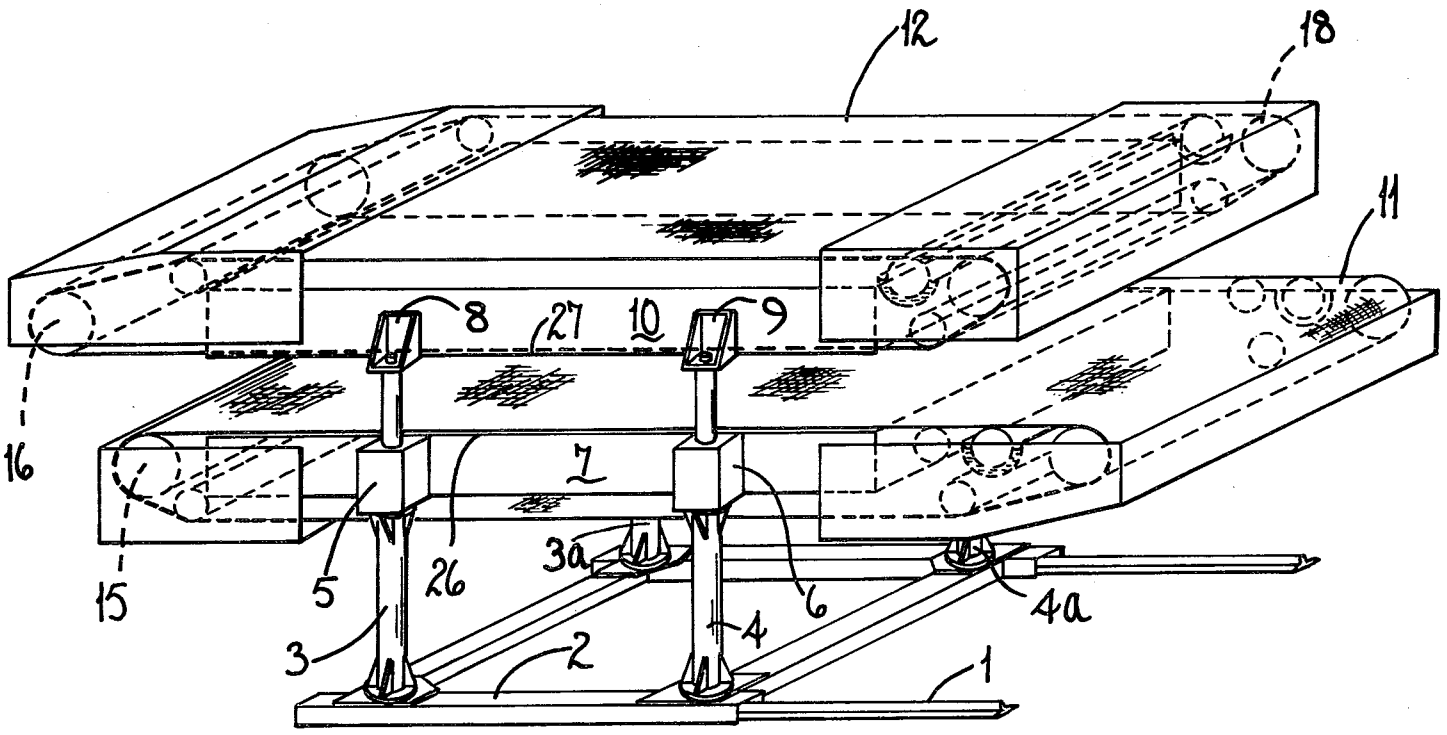
FIG. 2 is a diagrammatic perspective view of the apparatus in which the two metal tanks are spaced apart, the flat surfaces thereof being separated from each other.

In the operation of the illustrative apparatus in moistening and conditioning of leather, the leather is laid at the right-hand side (viewing the drawings) of the apparatus on the conveyor belt 11. The power means, namely the piston-cylinder units 5,6, is operated to hold the metal tank 10 in its raised condition, spaced apart from the lower tank 7 in the position shown in FIG. 2. The drive means is then actuated to move the conveyor belt 11 to the left and thus transport the leather on the belt in the direction of the arrow in FIG. 1; the leather is carried sandwiched between the belt 11 and the belt 12, into the gap between the metal tanks 7,10 until it occupies the region between the flat presser surfaces 26,27. With leather that is substantially free from folds it is possible to operate the illustrative apparatus with only the conveyor belt 11 being driven to carry the leather into the illustrative apparatus; preferably, however, both the lower conveyor belt 11 and upper conveyor belt 12 are driven to transport the leather into the region between the presser surfaces 26,27. When the leather is completely in the region between the flat presser surfaces 26,27 the conveyor belts 11,12 are stopped by the drive means, utilising a control device (not shown).

After the leather has been stopped in the pressing region between the presser surfaces 26,27 the piston-cylinder units 5,6 are operated to bring the upper metal tank 10 downwardly so that the flat surfaces 26,27 of the tanks 7,10 press the conveyor belts 11,12 together and thereby lightly press the leather lying between them. Under this compression an intensive heat transfer occurs from the flat presser surfaces 26,27 to the conveyor belts 11,12 whereby the water carried by the belts 11,12 is evaporated and transferred into the leather by an effect similar to the use of a flat-iron with an intermediate damp cloth for the moistening of textiles. In this way the leather is moistened to a desired extent. After the leather has been compressed by the tanks 7,10 for a desired period the piston-cylinder units 5,6 are operated to raise the upper tank 10 and separate it from the lower tank 7. When the upper tank 10 has been raised to separate the surfaces 26,27 sufficiently, the drive means operates to move the conveyor belts 11,12 and the now-moistened leather is conveyed out of the illustrative apparatus and runs over the roll 15 to be taken by some other means of conveyance for further processing.

The conveyor belts 11,12 are stopped for only a few seconds whilst pressure is exerted by the flat presser surfaces 26,27. The intensity of moistening of the leather is adjusted, mainly, by adjusting the depth to which the rollers 20,21 dip into the water in the water containers 23,24 as mentioned above. In addition, however, it is also possible to regulate the degree of moistening by changing the length of time for which the flat presser surfaces 26,27 are pressed together thereby adjusting the duration of moistening. If the duration of moistening is changed it is still possible to keep the through-put rate of the illustrative apparatus constant, since the transporting speed of the conveyor belts 11,12 may be adjusted in relation to the pressing time: thus, for a longer pressing time the transportation speed of the conveyor belts 11,12 may be increased by changing the speed of the drive means, to maintain the overall through-put rate of the illustrative apparatus constant. Thus the overall cycle time of the illustrative apparatus can be maintained constant, if the duration of pressing is changed, by changing the speed of the drive means and thus the transport speed of the conveyor belts 11,12.

The metal tanks 7,10 comprise a material which is corrosion resistant because in the moistening of leather the chemicals contained in the leather deriving from the tanning process may pass into the water carried by the conveyor belts 11,12 and may attack the metal tanks 7,10 if they are not corrosion resistant. The wall-thickness of the tanks need only be a few millimeters because the means for heating the flat presser surfaces 26,27 (namely the radiators 25) fitted inside the tanks 7,10 operate constantly during the operation of the apparatus and thus provide a sufficient heat reserve for the surfaces 26,27.

Whereas the illustrative apparatus is described in operation in moistening and conditioning leather, the illustrative apparatus may likewise be used for moistening and conditioning other materials which call for a corresponding processing operation.

Having described the invention, what I claim as new and desire to secure by Letters Patent of the United States is:

1. Apparatus for moistening and conditioning of sheet material, for example leather, comprising two presser members having flat presser surfaces situated opposite each other, power means connecting the presser members and by which the presser members may be moved relatively towards each other to exert pressure on the sheet material disposed therebetween and apart to relieve the pressure, heating means for heating at least one of the flat surfaces, at least one conveyor belt passing between the surfaces, drive means by which the belt can be moved while the surfaces are spaced apart by the power means to transport sheet material on the belt to the region between the flat presser surfaces for pressing by the flat presser surfaces and for carrying the sheet material out of the region after it has been pressed, and means for moistening the belt before it enters the region between the flat presser surfaces.

2. Apparatus according to claim 1 comprising heating means for heating both of the flat presser surfaces separately.

3. Apparatus according to claim 1 wherein the presser members comprise two metal tanks lying one above the other.

4. Apparatus according to claim 3 wherein the heating means for heating the flat presser surfaces comprises radiators situated inside the tanks.

5. Apparatus according to claim 1 comprising two conveyor belts between which the material is pressed.

6. Apparatus according to claim 5 comprising means for adjusting the moisture content of the belts.

7. Apparatus according to claim 5 comprising water-absorbent rollers over which the conveyor belts are guided for moistening the belts.

8. Apparatus according to claim 7 comprising water-containers from which the rollers absorb water and means for adjusting the depth to which the rollers dip into water in the containers whereby to adjust the moisture content of the belt.

* * * * *